US007422175B1

(12) United States Patent
Bobinchak et al.

(10) Patent No.: US 7,422,175 B1
(45) Date of Patent: Sep. 9, 2008

(54) APPARATUS AND METHOD FOR COOPERATIVE MULTI TARGET TRACKING AND INTERCEPTION

(75) Inventors: James Bobinchak, Ridgecrest, CA (US); Gary Hewer, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 114 days.

(21) Appl. No.: 11/700,967

(22) Filed: Jan. 17, 2007

Related U.S. Application Data

(63) Continuation of application No. 10/963,001, filed on Oct. 1, 2004, now Pat. No. 7,338,009.

(51) Int. Cl.
*F42B 15/01* (2006.01)
*G06F 19/00* (2006.01)
*F41G 7/00* (2006.01)
*F42B 15/00* (2006.01)

(52) U.S. Cl. ..... 244/3.15; 244/3.1; 244/3.16; 244/3.19; 89/1.11

(58) Field of Classification Search ..... 244/3.1–3.3; 89/1.11, 1.51; 342/61–68, 175, 195, 357.01–357.17; 701/1, 3, 200, 207–223; 102/382, 393, 473, 102/489, 507–510
See application file for complete search history.

(56) References Cited

U.S. PATENT DOCUMENTS 4,267,562 A * 5/1981 Raimondi ..... 89/1.11
4,522,356 A * 6/1985 Lair et al. ..... 244/3.15
4,726,224 A * 2/1988 D'Ausilio ..... 244/3.15
4,738,411 A * 4/1988 Ahlstrom et al. ..... 244/3.15
4,750,423 A * 6/1988 Nagabhushan ..... 89/1.51
5,206,452 A * 4/1993 Stamper et al. ..... 89/1.11
5,340,056 A * 8/1994 Guelman et al. ..... 244/3.16
5,344,105 A * 9/1994 Youhanaie ..... 244/3.14
5,379,966 A * 1/1995 Simeone et al. ..... 244/3.11
5,443,227 A * 8/1995 Hsu ..... 244/3.12
5,458,041 A * 10/1995 Sun et al. ..... 89/1.11
5,471,213 A * 11/1995 Hergesheimer ..... 342/67
5,511,218 A * 4/1996 Castelaz ..... 89/1.11
5,521,817 A * 5/1996 Burdoin et al. ..... 701/3
5,554,994 A * 9/1996 Schneider ..... 342/357.06
5,855,339 A * 1/1999 Mead et al. ..... 244/3.11
6,037,899 A * 3/2000 Weber ..... 342/357.06
6,196,496 B1 * 3/2001 Moskovitz et al. ..... 244/3.15
6,653,972 B1 * 11/2003 Krikorian et al. ..... 342/62
6,817,568 B2 * 11/2004 Spate et al. ..... 244/3.15
6,910,657 B2 * 6/2005 Schneider ..... 244/3.11
7,032,858 B2 * 4/2006 Williams ..... 244/3.15

OTHER PUBLICATIONS

Gazi V.; Passino K., Stability Analysis of Swarms, IEEE Transactions on Automatic Control, vol. 48, No. 4, Apr. 2003, pp. 692-697.

(Continued)

*Primary Examiner*—Bernarr E Gregory
(74) *Attorney, Agent, or Firm*—Brian F. Drazich

(57) ABSTRACT

The invention described herein provides an apparatus and a method to cooperatively track and intercept a plurality of highly maneuvering asymmetric threats using networks of small, low-cost, lightweight, airborne vehicles that dynamically self-organize into an ad hoc network topology. This is accomplished using distributed information sharing to maintain cohesion and avoid vehicle collisions, while cooperatively pursuing multiple targets. An oracle vehicle relays network information to a control base.

16 Claims, 3 Drawing Sheets

OTHER PUBLICATIONS

Bicchi A.; Pallottino L., On Optimal Cooperative Conflict resolution for Air Traffic Management Systems, IEEE Transactions on Intelligent Transportation Systems, vol. 1, No. 4.

Bertsekas D.P.; Castañon D.A.; Tsaknakis H., Reverse Auction and the Solution of Inequality Constrained Assignment Problems, SIAM Journal on Optimization, vol. 3, No. 2.

* cited by examiner

240

| | C1 | C2 | C3 | C4 | C5 | C6 | C7 |
|---|---|---|---|---|---|---|---|
| T1 | 0 | 0.3 | 0 | 0.2 | 0.2 | 0 | 0 |
| T2 | 0 | 0 | 0 | 0 | 0.8 | 0 | 0 |
| T3 | 0 | 0 | 0 | 0.1 | 0 | 0.1 | 0.1 |

APPARATUS AND METHOD FOR COOPERATIVE MULTI TARGET TRACKING AND INTERCEPTION

CROSS-REFERENCE TO RELATED APPLICATIONS

This is a continuation of application Ser. No. 10/963,001, filed Oct. 1, 2004, now U.S. Pat. No. 7,338,009.

This application is and was concurrently filed with U.S. patent application Ser. No. 10/963,004 having Navy Case No. 96446.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates generally to the field of self-organizing ad hoc network systems. More particularly, the present invention relates to a cooperative number of airborne vehicles that self organize to achieve an objective.

BACKGROUND OF THE INVENTION

Recent history has shown that while ships of the line generally have awesome firepower capability against both airborne threats and other ships of the line, they have very little capability to defend themselves against asymmetric threats in the form of small boats. These are typified by small boats such as jet skis, and speed boats that are determined to intercept and engage the warship at very close range. They can utilize large caches of onboard explosives or guided or unguided weapons to attack the ship. Primarily, this is a problem that is encountered in littoral regions of the earth and regions where waterways and commercial shipping restrict the warships from both maneuvering and utilizing their existing weapons systems. One of the most severe asymmetric threat tactics that will need to be countered is described as the swarm tactic. This involves many small boats utilizing their high speed and maneuverability in attacking a warship in sufficient numbers so as to overwhelm, by shear numbers, any self defense capability the ship might have. Although threats against ships are discussed it is noteworthy that swarm tactics may also be found in land based situations.

In view of the foregoing, there is a need for an airborne system that provides a means of engaging a number of aggressive combatants simultaneously.

SUMMARY OF THE INVENTION

An embodiment of the present invention includes an apparatus for intercepting at least one target including a plurality of target seeking and destruction devices, each of which has means for target detection, tracking, guidance, positioning, and wireless communication and means for the destruction of the target, with one of the devices being designated as an oracle. The devices are deployed from a deployment platform, acquire each target; and share data pertaining to each of the other devices and target data pertaining to each target. The devices determine a probability of intercept for each target, and then assigns each device to each target according to the probability of intercept for each target. The devices utilize a potential function to maintain inter-device spacing between the devices and track each target. The devices detect a maneuvering of each target and continually update a trajectory for each target according to the maneuvering and the inter-device spacing, until each target is intercepted and destroyed. The oracle has a means for being located behind said devices and relays the devices shared data and outcome to a control base.

Another embodiment of the present invention includes a method for intercepting at least one target including providing a plurality of target seeking and destruction devices having means for target detection, tracking, guidance, positioning, and wireless communication and means for the destruction of each target, one of the devices being designated as an oracle; deploying the devices from a deployment platform, acquiring each target, sharing data pertaining to each device and target data pertaining to each target with each of the other devices; determining a probability of intercept for each target within the devices; assigning each device to each target according to the probability of intercept for each target; utilizing a potential function within the devices to maintain inter-device spacing; tracking each target; detecting the maneuvering of each target; continually updating a trajectory for each target according to the maneuvering and said inter-device spacing until each target is intercepted and destroyed; providing means for the oracle to be located behind devices; and relaying the devices shared data and outcome to a control base via the oracle.

It is to be understood that the foregoing general description and the following detailed description are exemplary only and are not to be viewed as being restrictive of the present invention as claimed. These and other objects, features and advantages of the present invention will become apparent after a review of the following detailed description of the disclosed embodiments and the appended claims.

DETAILED DESCRIPTION OF THE INVENTION

Figure 1:
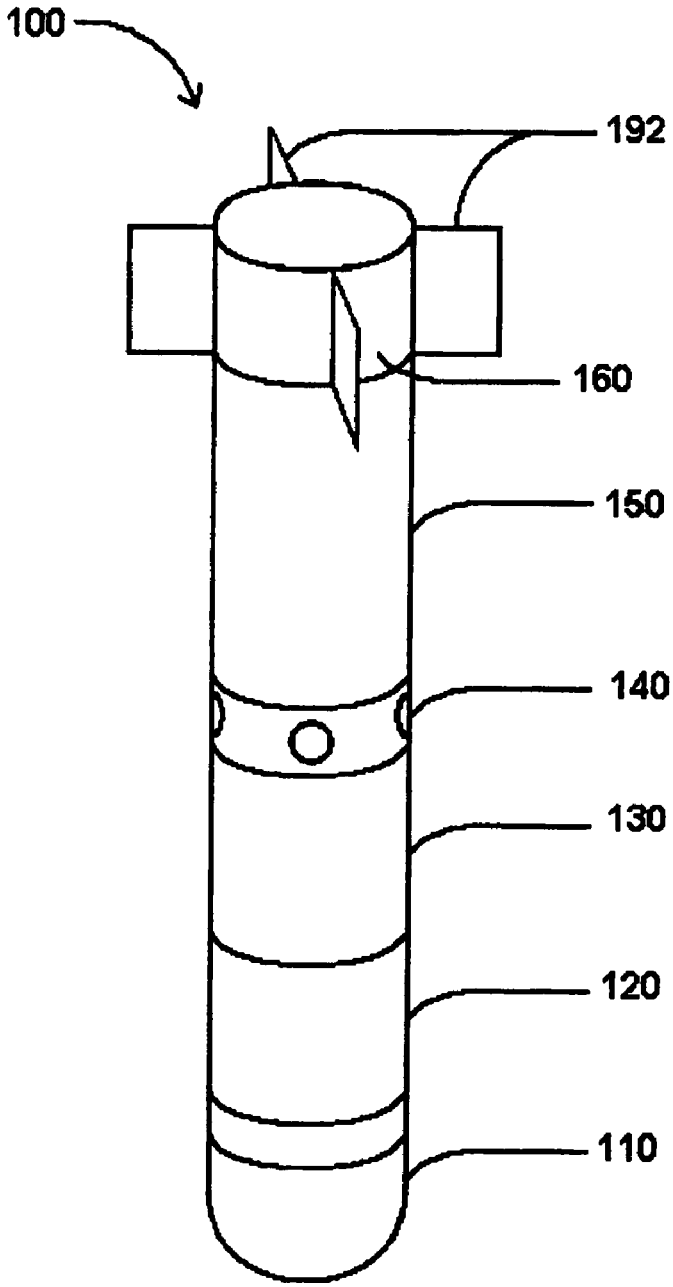
FIG. 1 illustrates a submunition canister according to an embodiment of the present invention.

Embodiments of the present invention increase the probability of killing one or more highly maneuvering targets utilizing airborne vehicles capable of interactive behavior with limited autonomous decisions. An inter-vehicle data link allows the vehicles to cooperate with one another to achieve a common goal, which is to seek and pursue targets in a way that will increase the probability of kill. A cooperative network of vehicles that can independently collect and share information among the network can achieve objectives that would not be possible by a single vehicle, or even a group of vehicles acting unilaterally. Distributed information sharing is key to achieving cooperation and is essential for performing tasks such as optimally assigning vehicles to engage targets, and for other tasks like formation flying.

In one embodiment of the present invention the airborne vehicles may take the form of submunition canisters (See FIG. 1) that are ejected from a delivery platform (such as an airplane), or multiple delivery platforms, and spread over an area to form a network of canisters that engage a plurality of highly maneuverable asymmetric targets. The canisters function cooperatively as autonomous agents relying on simple instructions to achieve a common goal. They are autonomous in that there is no centralized control, or hub, in the network to direct them. Each canister transmits a message to the other canisters in the network concerning its sensor measurements, and receives similar messages from the other canisters in the network. This message traffic is used to initially assign canisters to targets so as to maximize an objective, such as, for example, the global probability of intercepting all targets. Immediately thereafter, the message traffic is used for computing intercept trajectory and maintaining a safe inter-canister spacing during formation flying. It is also used for dynamically adjusting the inter-canister spacing as a function of target maneuver, and time-to-go, in order to increase the probability of killing the target. The canisters share information so that they all have access to the same knowledge database, stored locally within each canister itself, thereby creating database redundancy for a robust network. If a few canisters malfunction or are destroyed, the remaining canisters in the network will continue to function and cooperate without problems.

Every canister contains a global position system (GPS) receiver and inertial measurement unit (IMU) for measuring its position, velocity, and acceleration relative to some inertial reference, for example, the position of canister deployment. Canister altitude is obtained via an altimeter, such as for example a laser altimeter. A low-cost infrared (IR) or visible wavelength camera may be used for detecting the angular position of targets within the vicinity of, and relative to, the canister. Each canister also possesses wireless local area networking capability, such as IEEE 802.11b® (Wi-Fi) or Bluetooth® wireless technology, used to communicate with other canisters in the network. Measurements from each sensor on the canister are combined to form the message packet transmitted to the other canisters in the network. The message packet may include canister address, canister position, velocity, and acceleration, and the positions of any targets that happen to fall within the field-of-view (FOV) of the IR camera. An on-board processor (CPU), in conjunction with a software algorithm, utilizes the message traffic from all canisters to compute functions such as target-weapon assignments and to compute guidance commands for intercepting the assigned target. The message traffic is also used for maintaining network cohesion during target pursuit. It is noteworthy that since fuzing information is transmitted just prior to detonation, the GPS information can also be used for locating any unexploded ordinance.

Once the canisters are ejected from the delivery platform and assigned to a specific target, they maneuver so that those assigned to the same target form a virtually coupled local network. Each canister acts as a node in the network. Node connectivity is achieved using a potential function (discussed in detail below) of any reasonable shape so canisters become virtually coupled once they maneuver into the local neighborhood of another canister pursuing the same target. The potential function provides the local guidance and control for formation flying, while divert thrusters provide the necessary maneuver capability.

Robust assignment (discussed in detail below) algorithms provide the means for optimally assigning canisters to targets. For example, the assignment objective may be to maximize the global probability of intercepting all targets, or it may be to maximize the probability of intercepting a specific high-value target at the expense of missing a lower value target.

It should be understood that the examples and embodiments described herein are for illustrative purposes only and that various modifications or changes in light thereof will be suggested to persons skilled in the art and are to be included within the spirit and purview of this application and the scope of the appended claims.

Canister Components

Figure 3:
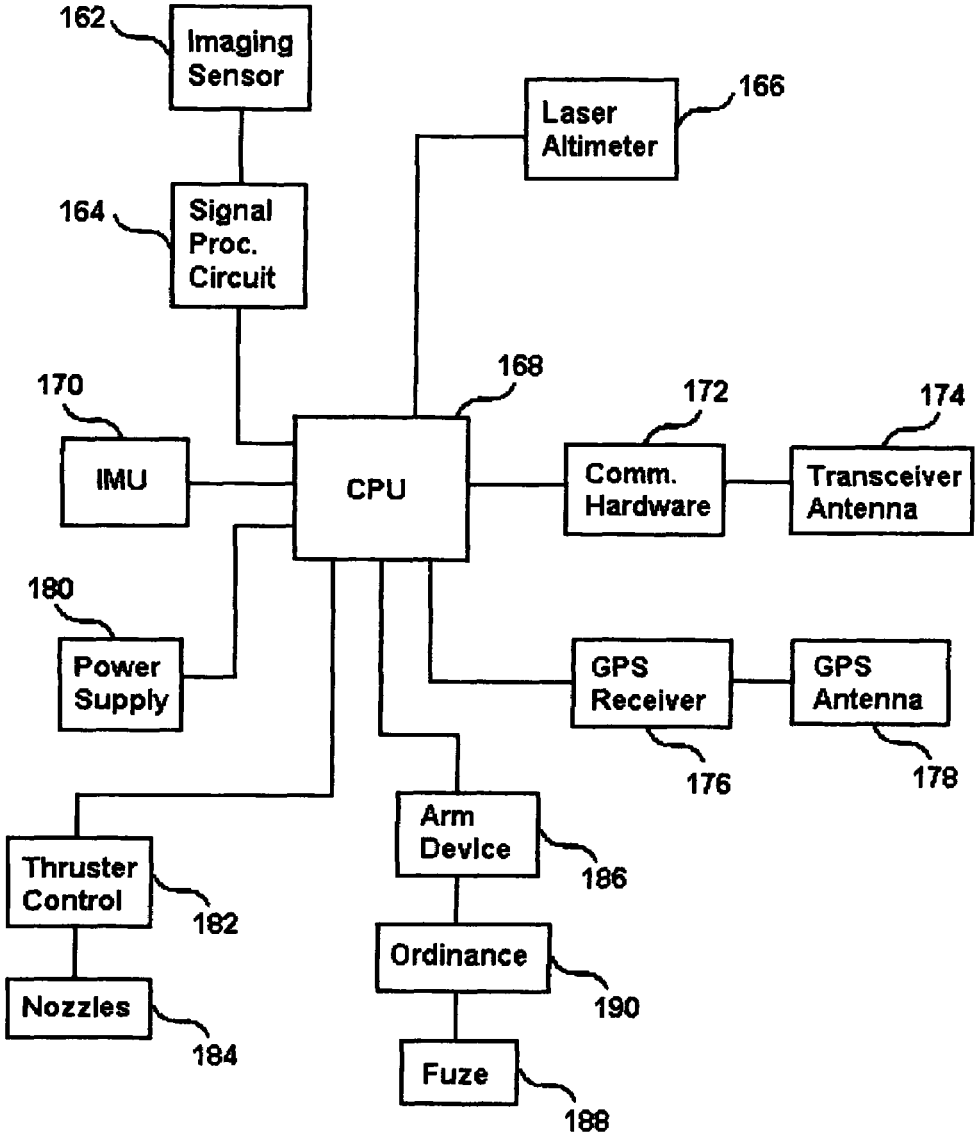
FIG. 3 is a block diagram illustrating the systems of a canister according to an embodiment of the present invention.

In one embodiment of the present invention illustrated in FIG. 1 and FIG. 3, the front end of a canister 100 contains a body-fixed infrared (IR) seeker 110 consisting of a focal plane array (FPA) imaging sensor 162 and associated image signal processing circuit 164, and a laser altimeter 166. The next section 120 contains the central processing unit (CPU) 168 that executes the tracking, guidance, and target-weapon assignment algorithms. This section also contains the inertial measurement unit (IMU) 170, power supply 180, transceiver antenna 174, and hardware for wireless network communication 172 with other members of the network. The next section 130 contains ordnance 190, safe-arm device 186 and fuse 188. The subsequent section 140 includes divert thruster control 182 and nozzles 184 followed by the thruster propellant section 150. The tail section 160 contains stabilization fins 192, global position system (GPS) receiver 176, and GPS antenna 178.

A Kalman filter may be used for target tracking (by the CPU) since it provides optimal performance against manned maneuvering targets. In addition, a proportional navigation guidance law may be used in conjunction with the Kalman filter in calculating the desired acceleration to be applied to the canister.

Network Communication and Message Traffic

One embodiment of the network communication system employs Bluetooth® wireless technology. The Bluetooth® protocol is designed to operate in noisy frequency environments. It uses adaptive frequency hopping to reduce interference between other wireless technologies sharing the 2.4 GHz spectrum. Bluetooth® uses a baseband layer, implemented as a link controller, to carry out low-level routines like link connection and power control. The baseband transceiver applies a time-division duplex scheme that allows the canisters to alternately transmit and receive data packets in a synchronous manner. Data packets consist of an access code, header, and payload. The access code is used for timing synchronization, offset compensation, paging and inquiry. The header contains information for packet acknowledgement, packet numbering for out-of-order packet reordering, flow control, slave address and error checksum. The packet payload contains the combined data from all the sensors on the canister. Data include canister position, velocity, and acceleration, and the positions of any targets detected within the IR sensor FOV. A unique canister identification number, or address, is also needed for use during target-weapon pairing. This data packet is transmitted to all canisters in the network.

Virtual Coupling

The canisters' behavior is a result of the interplay between long-range attraction and short-range repulsion (see Gazi V.; Passino K., *Stability Analysis of Swarms*, IEEE Transactions on Automatic Control, Vol. 48, No. 4, April 2003, pp. 692-697). This behavior is implemented in one embodiment of the present invention using a piece-wise linear virtual spring having a potential function with a minimum value at some finite distance from the canister. When two or more canisters are within the local neighborhood of one another, they move toward this minimum potential. As an example, the potential function of a piece-wise linear virtual spring is $$V = \frac{1}{2}k(r - r_o)^2$$

where $r_o$ is the virtual spring rest length, k is the spring constant, and r is the canister separation distance. When the canisters are separated by a distance equal to the rest length of the virtual spring (i.e. $r=r_o$) they are at the minimum value of their neighbor's potential function and form a stable network. High spring stiffness is used when $r<r_o$, and low spring stiffness is used when $r>r_o$. This piece-wise linear spring has the effect of quickly forcing canisters to separate if they get too close to one another, and easing them back into position when they are too far apart. A damping term, proportional to the canisters relative velocity, is used to prevent oscillations within the swarm. The first derivative of the potential function yields the steering command (i.e. commanded force) that is superimposed with the guidance command from the guidance-and-control computer (CPU). This resultant command is sent to the divert thrusters to generate the force required to maneuver the canister to the location of minimum potential among its neighbors, while simultaneously pursing its assigned target.

Maneuvering targets are inherently more difficult to intercept than non-maneuvering targets. When a maneuver is detected, the virtual spring rest length is increased so the canisters are forced to spread out over a wider area, thereby increasing the probability that one of them will intercept an unpredictably maneuvering target. In the absence of a maneuver the virtual spring rest length is decreased as a function of time-to-go, ensuring that all canisters in the swarm are closely clustered at time of target intercept.

A simple fading memory average of the innovations (i.e. measurement residuals) is used to detect if a target maneuver has taken place (see Bicchi A.; Pallottino L., *On Optimal Cooperative Conflict resolution for Air Traffic Management Systems*, IEEE Transactions on Intelligent Transportation Systems, Vol. 1, No. 4, December 2000, pp 221-232) and is given by $$u(k)=\alpha u(k-1)+d(k)$$

with $$d(k)=v(k)^T S(k)^{-1} v(k)$$

where $0<\alpha<1$, v(k) is the innovation vector at time k, and S(k) is the corresponding covariance matrix that was calculated during the Kalman filtering process. If u(k) exceeds a threshold, determined empirically, then a maneuver has occurred.

Target-Canister Pairing

Figures 2A, 2B:
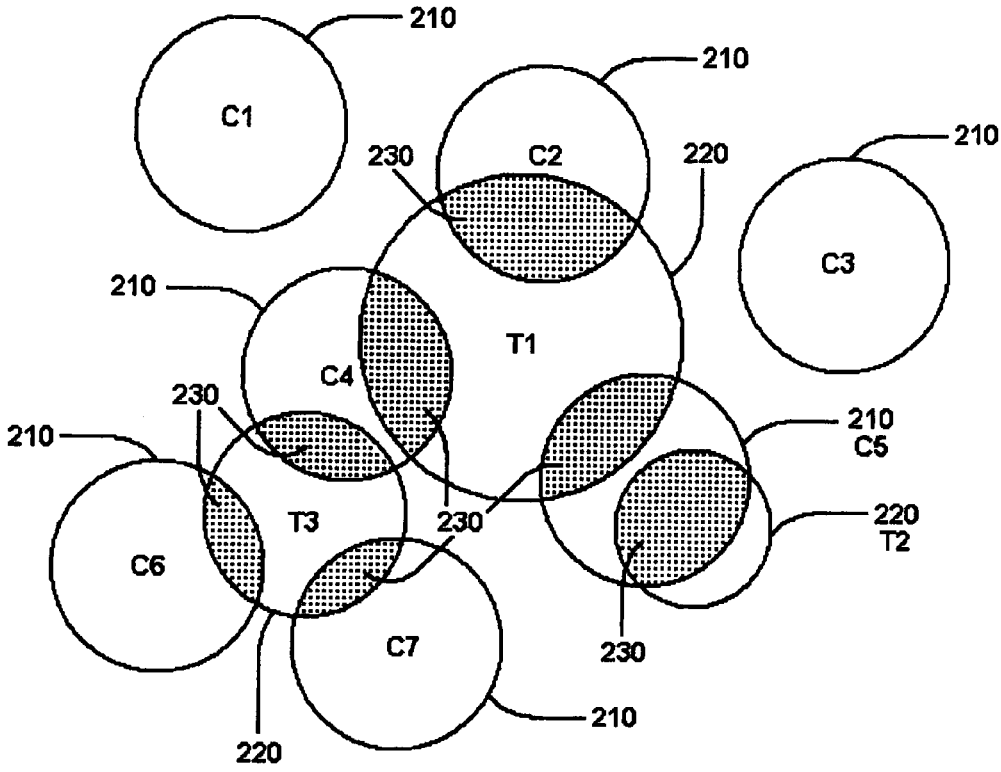
FIG. 2 illustrates the probability of canisters intercepting targets according to an embodiment of the present invention.

In an embodiment of the present invention each canister is capable of intercepting at most one target, however, each target may be attacked by more than one canister. The probability that a canister can intercept a target is used as a means of matching canisters to targets. This is illustrated in FIG. 2, where it is assumed that the delivery platform has ejected the canisters C1, C2, . . . , C7, widely over the threats T1, T2, . . . , T4. Since the canisters are falling, they will hit the ground within some time-to-go interval. Given this time-to-go interval each canister has a finite area, known as the canister reachability area, within which it may maneuver 210. Likewise, each target may maneuver within a finite area during that same time interval and so has associated with it a target reachability area 220. For simplicity the areas are illustrated to be circular, but they need not be. The probability of a canister intercepting a particular target is the ratio of the overlapped area 230 to the total target reachability area. If there is no overlap between two circles, then the probability of intercept is zero. A sample table of probabilities of intercept is shown 240.

In another embodiment a method of generating the probability table is to simply use inverse range, or any monotonically decreasing function of range, as the probability of intercept. This is possible since range is a good indicator as to whether or not a canister can intercept a target. Targets that are closer to a canister are easier to detect, track, and therefore intercept, than targets at a distance.

It is noteworthy that a problem occurs when a canister is directly over a target, or nearly so, but the two are moving in opposite directions. Since the canister is very small and lightweight, it might not possess enough impulse to change its direction of motion to coincide with that of the target. Even if the required impulse were available there may not be enough time to make such a drastic course change since the canister is dropped from a relatively low altitude (e.g. 500 to 1000 feet) and is falling due to gravity. To overcome this problem, canister-target closing velocity may also be incorporated into the probability-of-intercept when matching canisters to targets.

Once a table of intercept probabilities is generated, an assignment algorithm is used to maximize the global probability of intercepting all targets. One embodiment of the present invention utilizes the reverse auction algorithm proposed by Bertsekas for the solution of unconstrained multiassignment problems (see Bertsekas D. P., *Network Optimization: Continuous and Discrete Models*, Athena Scientific, Belmont Mass., May 1998). In another embodiment constrained multiassignment problems target-canister pairing is accomplished using the algorithms proposed by Castañon (see Bertsekas D. P.; Castañon D. A.; Tsaknakis H., *Reverse Auction and the Solution of Inequality Constrained Assignment Problems*, SIAM Journal on Optimization, Volume 3, Number 2, May, 1993, pp. 268-297) and Kennington (see Kennington J. L.; Helgason R. V., *Algorithms for Network Programming*, John Wiley & Sons, New York, 1980). The latter two algorithms have the advantage of allowing the number of canisters per target to be specified during the assignment process. This enables the allocation of more canisters to high-valued targets and fewer to low-valued targets, or to balance the number of canisters per target while maximizing the global probability of intercept.

Battle Damage Indication

Since targets that evade the canisters (known as "leakers") in the attack are potentially lethal, any surviving threat must be reengaged to assure maximum ship survival. In another embodiment of the present invention a wireless communications link between the control base (such as for example a ship) and the deployment platform is added, with the ability to provide battle damage indication (BDI). BDI is possible because each canister maintains an internal database, compiled via wireless communications with its peers, containing the GPS location of all canisters and targets in the engagement. Since the deployment platform does not engage the threats, it is free to loiter over the target area and monitor the low-power radio message traffic between the network canisters. Just prior to canister detonation, targeting and fuzing information is transmitted to the deployment platform, which in turn amplifies the signal and relays the information back to the ship so it may take appropriate action against the "leakers". In addition, the location of the canisters may be used to clean up and dispose of unexploded or malfunctioning canisters.

In another embodiment of the present invention one canister in the network is designated as the "oracle". This single canister may be outfitted with a drogue chute to slow its decent, and a high-power transmitter to relay radio message traffic regarding the destruction of targets and continuing threats back to the ship or to the deployment platform.

An Example of the Solution to the Asymmetric Multiassignment Problem

As previously discussed, once a table of canister-target intercept probabilities is generated, an assignment algorithm is used to maximize the global probability of intercepting all targets. The actual linear programming problem to be solved is $$\text{maximize} \sum_{(i,j)\in A} a_{ij}x_{ij} \quad \text{(maximize global probability of intercept)}$$

subject to $$1 \le \sum_{j\in A(i)} x_{ij} \le \alpha_i \quad \forall\, i = 1, \ldots, m$$

(multiple canisters assigned to each target)

$$\sum_{i\in B(j)} x_{ij} = 1 \quad \forall\, j = 1, \ldots, n$$

(one target assigned to each canister)

$$0 \le x_{ij} \quad \forall\, (i, j) \in A$$

(0 or 1 for all possible pairs)

$$\sum_{i=1,\ldots,m} \alpha_i \ge n$$

(due to the equality constraint)

where $x_{ij}$=decision variable (0 or 1)

A(i)=set of canisters to which target i can be assigned

B(j)=set of targets to which canister j can be assigned

A=set of all possible pairs (i, j)

$a_{ij}$=probability of canister j intercepting target i $\alpha_i$=upper bound on the number of canisters to which target i can be assigned m=total number of targets n=total number of canisters This problem simply states that the global probability of intercept must be maximized while assuring that every target i is assigned to at least one canister, but no more than $\alpha_i$ canisters, and every canister j is assigned to exactly one target. Since $\alpha_i$ is an upper limit on the assignment, this is a constrained multiassignment problem. To generate an unconstrained multiassignment problem, let $\alpha_i \to \infty$.

Using duality theory the unconstrained multiassignment problem becomes $$\text{minimize} \sum_{i=1}^{m} \pi_i + \sum_{j=1}^{n} p_j + (n-m)\lambda \quad \text{(minimize cost network flow)}$$

subject to $$\pi_i p_j \geqq a_{ij} \;\forall (i,j)\epsilon A \text{ (complementary slackness)}$$

$$\lambda \geqq \pi_i \;\forall i=1, \ldots, m \text{ } (\lambda=\pi_i \text{ for multiassigned row})$$

where $\pi_i$=profit of target i $p_j$=price of canister j $\lambda$=maximum profit One method of solving the unconstrained multiassignment problem is the forward/reverse auction algorithm proposed by Bertsekas (see cite above for *Network Optimization*). The algorithm is implemented as follows:

Forward Auction:

Bidding Phase For each target i that is unassigned under the assignment S, find the best canister $j_i$ having best value $v_i$ $$j_i = \arg\max_{j\in A(i)} \{a_{ij} - p_j\}$$

$$v_i = \max_{j\in A(i)} \{a_{ij} - p_j\}$$

and find the second best value $$w_i = \max_{j\in A(i), j\neq j_i} \{a_{ij} - p_j\}$$

If $j_i$ is the only canister in A(i), then define $w_i$ to be $-\infty$.

Compute the bid of target i $$b_{ij_i} = p_{j_i} + v_i - w_i + \epsilon \text{ where } \epsilon < 1/n.$$

Assignment Phase For each canister j, let P(j) be the set of targets from which j received a bid during the bidding phase of the iteration. If P(j) is nonempty, increase $p_j$ to the highest bid $$p_j = \max_{i\in P(j)} b_{ij}$$

and remove from the assignment S any pair (i, j) and add to S the pair ($i_j$, j), where $i_j$ is the target in P(j) attaining the maximum above.

Reverse Auction:

For each canister j that is unassigned under the assignment S (if all canisters are assigned, the algorithm terminates), find best target $i_j$ having best value $\beta_j$ $$i_j = \arg\max_{i\in B(j)} \{a_{ij} - \pi_i\}$$

-continued $$\beta_j = \max_{i \in B(j)} \{a_{ij} - \pi_i\}$$

and find the second best value $$\omega_j = \max_{i \in B(j), i \neq i_j} \{a_{ij} - \pi_i\}$$

If $i_j$ is the only target in B(j), then define $\omega_j$ to be $-\infty$. Let $$\delta = \min\{\lambda - \pi_{i_j}, \beta_j - \omega_j + \epsilon\}$$

where $$\lambda = \max_{i=1,\ldots m} \pi_i \text{ and } \varepsilon < 1/m.$$

Add ($i_j$, j) to the assignment S and set $$p_j = \beta_j - \delta$$

$$\pi_{i_j} = \pi_{i_j} + \delta$$

If $\delta > 0$, then remove from the assignment S the pair ($i_j$, j'), where j' is the canister that was assigned to $i_j$ under S at the start of the iteration. Continue iterating until all canisters are assigned.

Note that the forward auction proceeds up to the point were each target is assigned to a single distinct canister. Since some canisters are still unassigned, the reverse auction is used to assign the remaining unassigned canisters.

Those of ordinary skill in the art will readily acknowledge that additional embodiments of the present invention may be made without departing or diverting from the scope of the present invention. Although the description above contains much specificity, this should not be construed as limiting the scope of the invention but as merely providing an illustration of the presently preferred embodiment of the invention. Thus the scope of this invention should be determined by the appended claims and their legal equivalents.

What is claimed is:

1. An apparatus for intercepting at least one target comprising:

a plurality canisters each adapted to be deployed from a platform;

said plurality of canisters each having means operable for the destruction of a target;

said plurality of canisters each having means operable for guidance, position determination, target detection, target tracking, target assignment, target intercept, and fuzing the means for the destruction of a target;

said plurality of canisters each having means operable for measurement, collection, storage, and processing of information relating to guidance, position, target detection, target tracking, target assignment, target intercept, and fuzing the means for the destruction of a target;

said plurality of canisters each having means operable for wireless communication with each other canister of said plurality of canisters to form a distributed database of said information shared amongst said plurality of canisters;

said plurality of canisters each adapted upon deployment to operate said wireless communication, information measurement, information collection, information storage, information processing, target detection, target tracking, guidance, and position determination means to detect and track a plurality of targets;

said plurality of canisters each adapted to operate a predetermined algorithm operable to determine a probability of intercept for each said tracked target;

said plurality of canisters each adapted to operate a predetermined algorithm operable to assign one tracked target for intercept by said canister according to said probability of intercept;

said plurality of canisters each adapted to operate said wireless communication, information measurement, information collection, information storage, information processing, target detection, target tracking, guidance, and position determination means to calculate and periodically update a trajectory for intercept of said assigned target by said canister;

said plurality of canisters each adapted to operate said wireless communication, information measurement, information collection, information storage, information processing, target detection, target tracking, guidance, and position determination means to guide said canister along an intercept trajectory until said assigned target is intercepted;

each canister adapted upon intercept of said assigned target to deploy said means for the destruction of a target.

2. The apparatus of claim 1 wherein said means for wireless communication, information measurement, information collection, information storage, information processing, guidance, position determination, target detection, target tracking, target assignment, target intercept, and fuzing comprises:

a focal plane array imaging sensor;

an image signal processing circuit operationally coupled with said focal plane array;

a computer processing unit (CPU) operational to run routines and algorithms for wireless communication, information measurement, information collection, information storage, information processing, guidance, position determination, target detection, target tracking, target assignment, target intercept, and fuzing said means for the destruction of a target;

said CPU operationally coupled with said image signal processing circuit;

a wireless communications transceiver operationally coupled with said CPU;

a transceiver antenna operationally coupled with said wireless communications transceiver;

a global positioning system (GPS) antenna;

a GPS receiver operationally coupled with said GPS antenna and said CPU;

an inertial measurement unit (IMU) operationally coupled with said CPU;

a divert thruster controller operationally coupled with said CPU; and a plurality of thrusters operationally coupled with said divert thruster controller.

3. The apparatus of claim 1 wherein said means for the destruction of a target comprises:

a computer processing unit (CPU) operational to run routines and algorithms for arming and fuzing an ordnance;

said CPU operationally coupled with said arm device and said fuze;

said arm device operationally coupled with said fuze; and said fuze operationally coupled with an ordnance.

4. The apparatus of claim 1 wherein each of said canisters is an aerial canister.

5. The apparatus of claim 1 wherein the algorithm for determining a probability of intercept calculates a target reachability area, a canister reachability area, and the proportion of the target reachability area included within the canister reachability area.

6. The apparatus of claim 1 wherein the algorithm for determining a probability of intercept utilizes a monotonically decreasing function of range.

7. The apparatus of claim 1 wherein said platform is an aircraft or watercraft.

8. The apparatus of claim 1 wherein for each canister said information comprises canister address, canister position, canister velocity, canister acceleration, time-to-go, and detected target position.

9. The apparatus of claim 1 wherein said plurality of canisters are each adapted to be deployed from multiple types of platforms.

10. The apparatus of claim 1 wherein said means operable for wireless communication utilizes an adaptive frequency hopping protocol or an IEEE 802.11b protocol.

11. The apparatus of claim 1 further including a potential function for spacing apart deployed canisters one from another wherein said potential function utilizes a piece-wise linear virtual spring algorithm and said potential function has a selected minimum value corresponding to a predetermined distance from a canister.

12. The apparatus of claim 11 wherein said potential function is a function of time-to-go.

13. The apparatus of claim 11 wherein said potential function is a function of tracked target motion.

14. The apparatus of claim 1 wherein the algorithm for assigning each of said canisters to a single tracked target includes calculating a solution to a constrained multiassignment problem or to an unconstrained multiassignment problem.

15. The apparatus of claim 1 wherein the algorithm for assigning each of said canisters to a single tracked target is a reverse auction algorithm.

16. The apparatus of claim 1 wherein one of said plurality of canisters deployed includes means for slowing the descent of the canister.

* * * * *